US009890715B1

(12) United States Patent
Zhang

(10) Patent No.: US 9,890,715 B1
(45) Date of Patent: Feb. 13, 2018

(54) VACUUM FOR A VACUUM CONSUMPTION DEVICE

(71) Applicant: Ford Global Technologies, LLC, Dearborn, MI (US)

(72) Inventor: Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/268,219

(22) Filed: Sep. 16, 2016

(51) Int. Cl.

| | |
|---|---|
| ***F02D 9/12*** | (2006.01) |
| ***F04F 5/14*** | (2006.01) |
| ***F02D 9/02*** | (2006.01) |
| ***F02M 35/10*** | (2006.01) |

(52) U.S. Cl.
CPC ..... *F02D 9/12* (2013.01); *F02D 9/02* (2013.01); *F02M 35/10118* (2013.01); *F02M 35/10229* (2013.01); *F04F 5/14* (2013.01); *F02D 2009/024* (2013.01)

(58) Field of Classification Search
CPC ..... F02D 9/12; F02D 9/02; F02D 2009/024; F02M 35/10118; F02M 35/10229; F04F 5/14
See application file for complete search history.

(56) References Cited

U.S. PATENT DOCUMENTS 2,140,529 A * 12/1938 Kemp ..... F02D 9/00 137/382
4,178,890 A * 12/1979 Yamabe ..... F02D 11/08 123/320
5,007,395 A * 4/1991 Wakeling ..... F02D 9/18 123/337
5,515,674 A * 5/1996 Kaufmann, Jr. ..... F01N 3/34 60/308
7,032,578 B2 4/2006 Liu et al.
7,104,749 B2 * 9/2006 Frutschi ..... F02C 7/045 181/214
8,181,453 B2 * 5/2012 Goplen ..... F01N 3/34 60/317
8,261,716 B2 * 9/2012 Bergbauer ..... F02D 9/1015 123/320
8,925,520 B2 * 1/2015 Pursifull ..... F02D 31/005 123/339.23
9,371,074 B1 * 6/2016 Luehrsen ..... B60W 50/02
2005/0092944 A1 * 5/2005 Patterson ..... F16K 7/08 251/4
2007/0036694 A1 2/2007 Nishioka et al.
2009/0301577 A1 * 12/2009 Carter, III ..... F16K 11/105 137/484.2
2015/0114350 A1 * 4/2015 Pursifull ..... F02M 35/10019 123/445
2016/0305377 A1 * 10/2016 Stefaniak ..... F02M 35/10229
2016/0369718 A1 * 12/2016 Pursifull ..... F01M 13/00

OTHER PUBLICATIONS

Zhang, Xiaogang, et al., "Method and System for Vacuum Generation in an Intake," U.S. Appl. No. 15/081,151, filed Mar. 25, 2016, 61 pages.

* cited by examiner

*Primary Examiner* — Joseph Dallo
(74) *Attorney, Agent, or Firm* — Julia Voutyras; McCoy Russell LLP

(57) ABSTRACT

Methods and systems are provided for vacuum generating devices. In one example, a system includes a vacuum generating device having an annular venturi passage located between two identical halves.

20 Claims, 7 Drawing Sheets

VACUUM FOR A VACUUM CONSUMPTION DEVICE

FIELD

The present description relates generally to devices for providing vacuum to one or more vacuum consumption devices.

BACKGROUND/SUMMARY

Vehicle systems may include various vacuum consumption devices that are actuated using vacuum. These may include, for example, a brake booster and a purge canister. Vacuum used by these devices may be provided by a dedicated vacuum pump. In other embodiments, one or more aspirators (alternatively referred to as ejectors, venturi pumps, jet pumps, and eductors) may be coupled in the engine system that may harness engine airflow and use it to generate vacuum.

In yet another example embodiment shown by Bergbauer et al. in U.S. Pat. No. 8,261,716, a control bore is located in the wall of the intake such that when the throttle plate is at idle position, vacuum generated at the periphery of the throttle is used for a vacuum consumption device. Therein, the positioning of the throttle plate in an idle position provides a constriction at the throttle plate's periphery. The increasing flow of intake air through the constriction results in a venturi effect that generates a partial vacuum. The control bore is sited so as to utilize the partial vacuum for a vacuum consumption device.

The inventors herein have identified potential issues with the above approach. As an example, the vacuum generation potential of the throttle is limited. For example, a single control bore at one location in the intake, as shown in U.S. Pat. No. 8,261,716, is utilized by the vacuum consumption device even though vacuum may be generated at the entire periphery of the throttle. To use vacuum generated at the entire periphery of the throttle, more control bores may be needed in the intake passage. However, fabricating these control bores may result in significant modifications to the design of the intake passage which can increase related expenses.

In the approaches that use one or more aspirators to generate vacuum, additional expenses may be incurred because of individual parts that form the aspirator including nozzles, mixing and diffusion sections, and check valves. Further, at idle or low load conditions, it may be difficult to control the total air flow rate into the intake manifold since the flow rate is a combination of leakage flow from the throttle and airflow from the aspirator. Typically, an aspirator shut off valve (ASOV) may be included along with the aspirator to control airflow but with added cost. Further, installing aspirators in the intake can lead to constraints on space availability as well as packaging issues.

In one example, the issues described above may be addressed by a method for replenishing vacuum in a vacuum consumption device by flowing air through an annular venturi passage located between identically shaped upper and lower halves of a vacuum generating device. In this way, the vacuum generating device provides vacuum without electronic valves and/or actuators. As one example, air flows through one or more venturi passages of the vacuum generating device. Vacuum is supplied from a venturi passage, through a passage located in the upper half, to the vacuum consumption device. In one example, the vacuum generating device is located in an intake passage and the upper half is configured to slide to and away from the lower half. A position of the upper half is based on an engine operating condition. As an example, the upper half is spaced away from the lower half for higher engine loads and pressed against the lower half for lower/idle engine loads. Thus, the vacuum generating device may adjust intake air flow to an engine while simultaneously providing vacuum to the vacuum consumption device.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-6 are shown approximately to scale.

DETAILED DESCRIPTION

Figure 1:
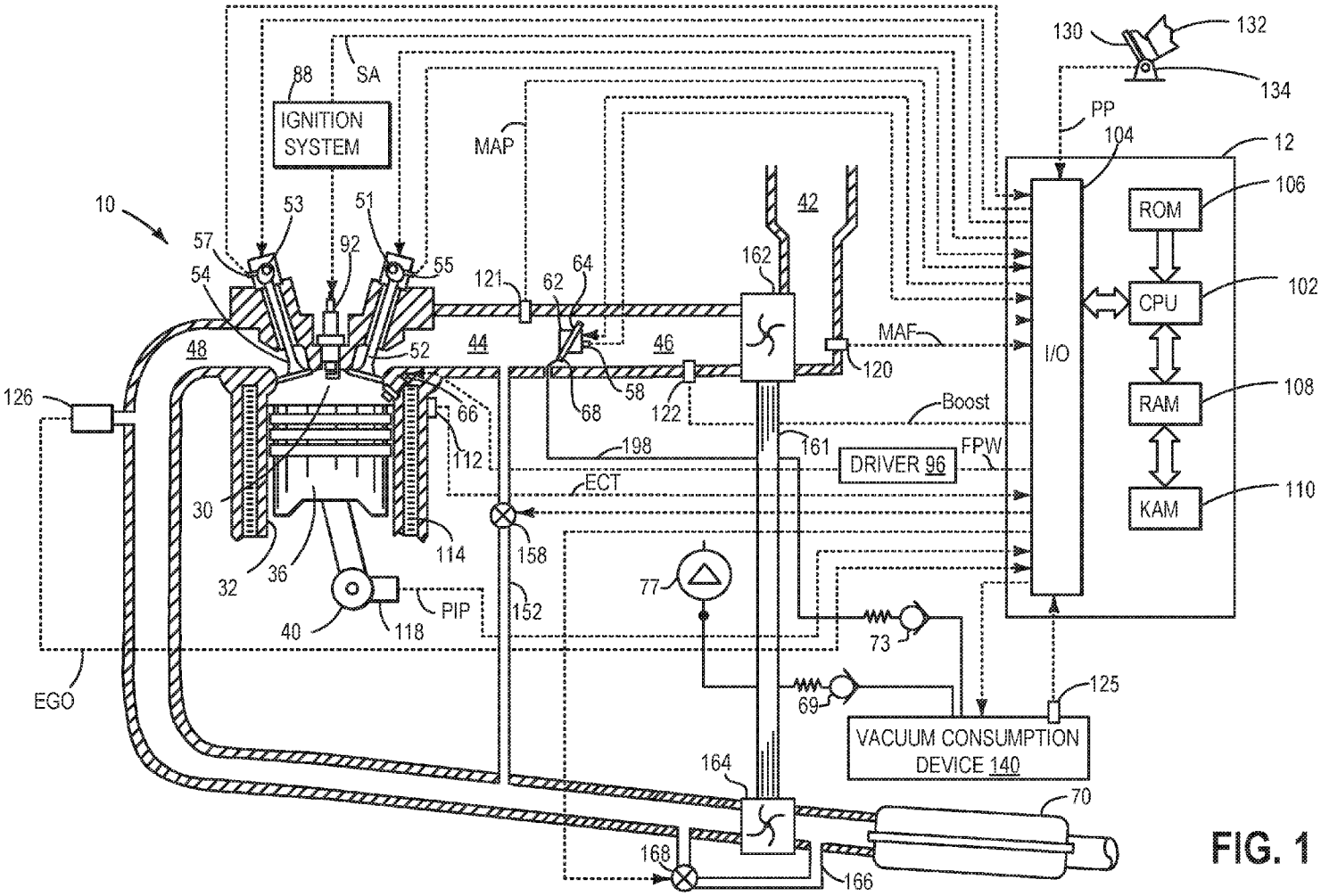
FIG. 1 portrays a schematic diagram of an engine in accordance with the present disclosure.
Figure 2:
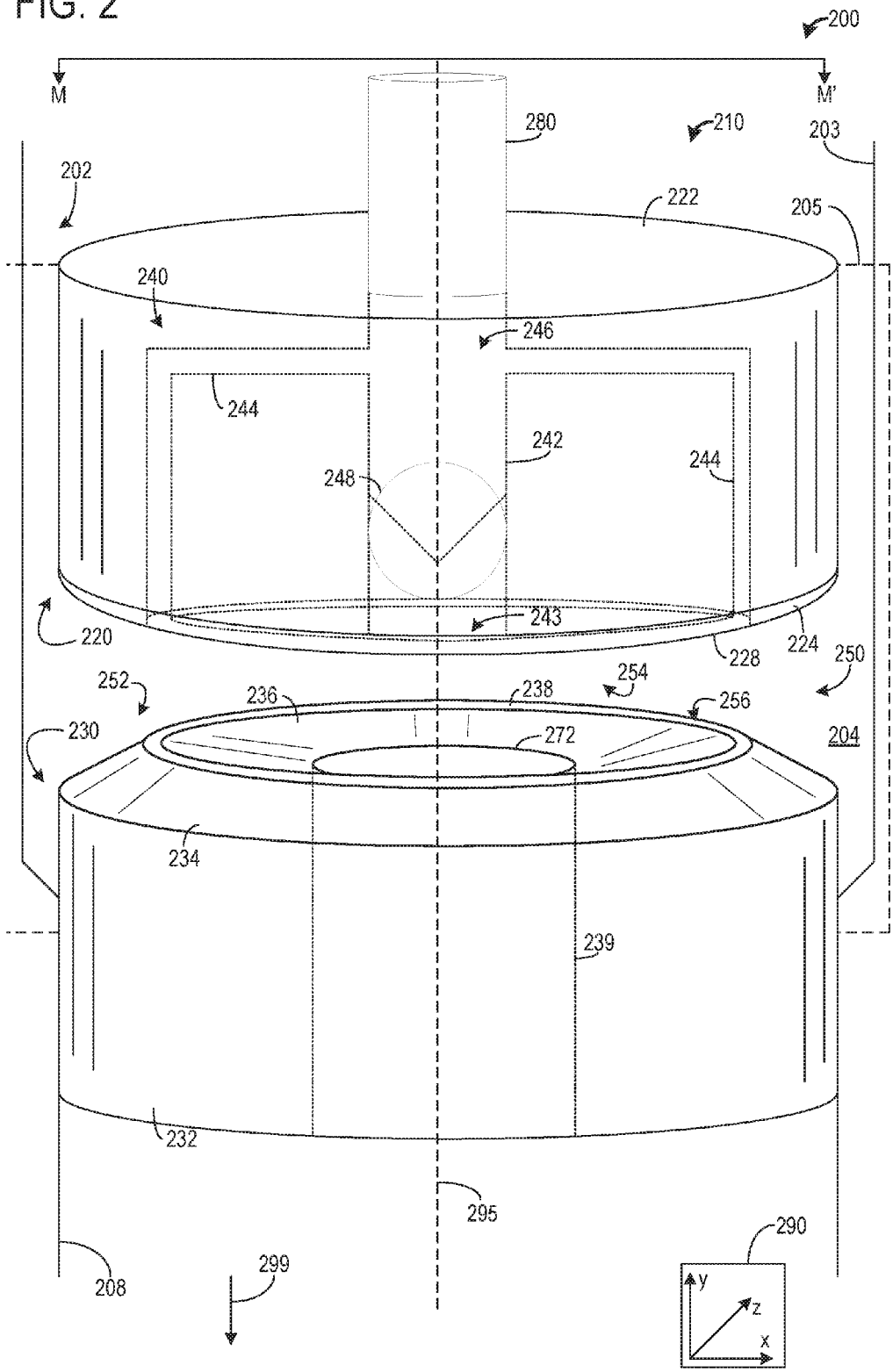
FIG. 2 depicts a first embodiment of a vacuum generating device.
Figure 3:
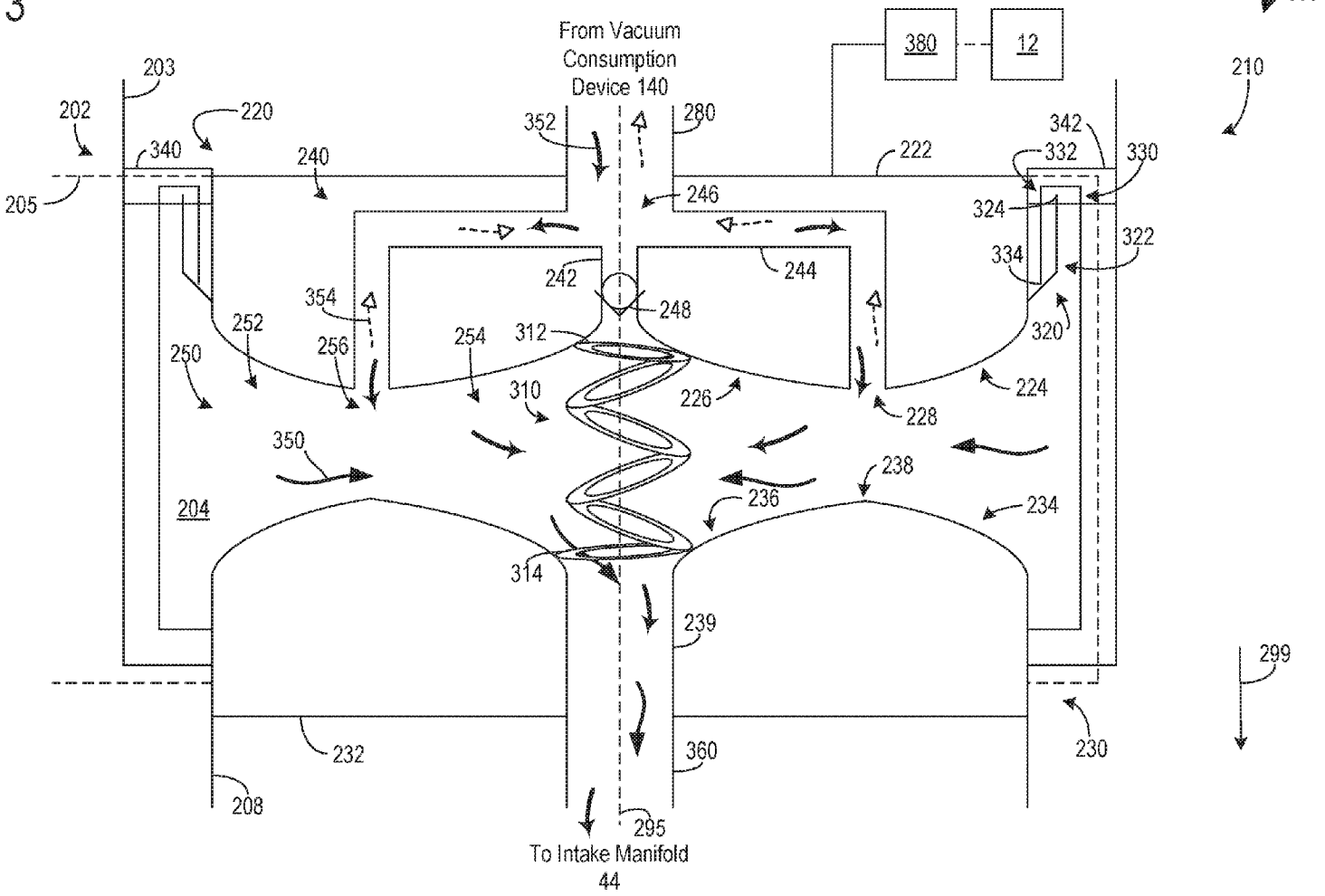
FIG. 3 depicts a first position of the vacuum generating device.
Figure 4:
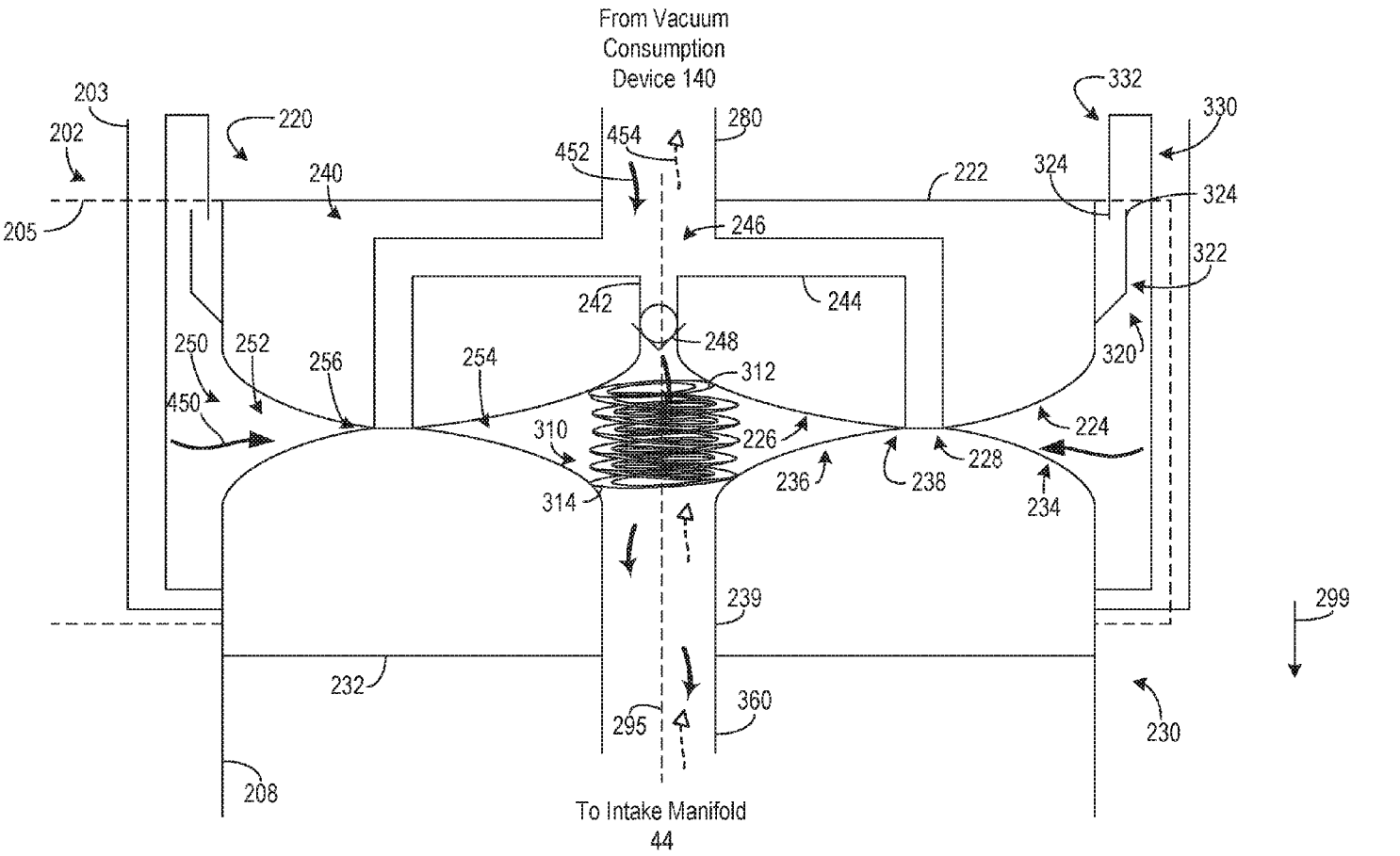
FIG. 4 depicts a second position of the vacuum generating device.
Figure 5:
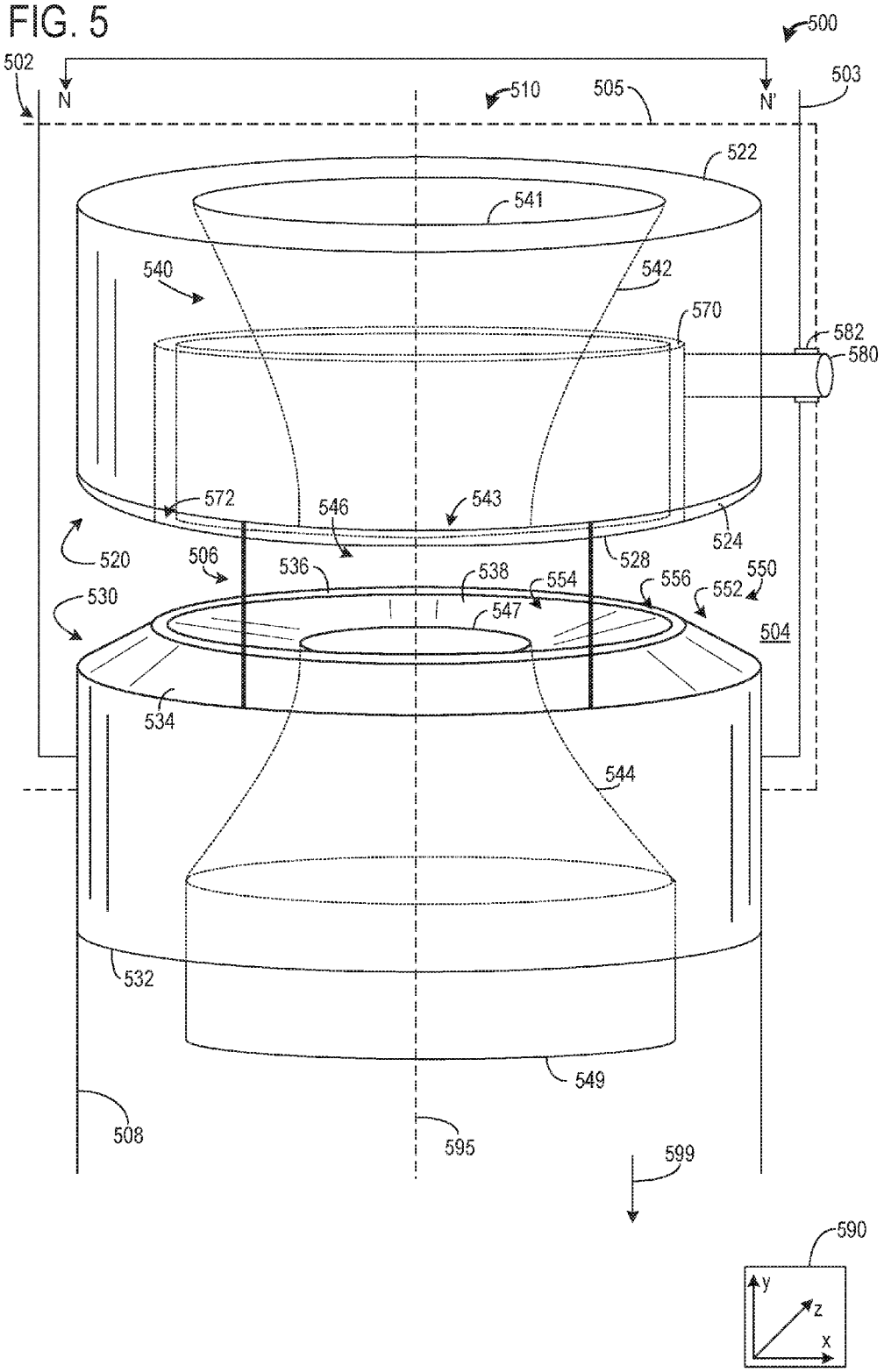
FIG. 5 depicts a second embodiment of a vacuum generating device.
Figure 6:
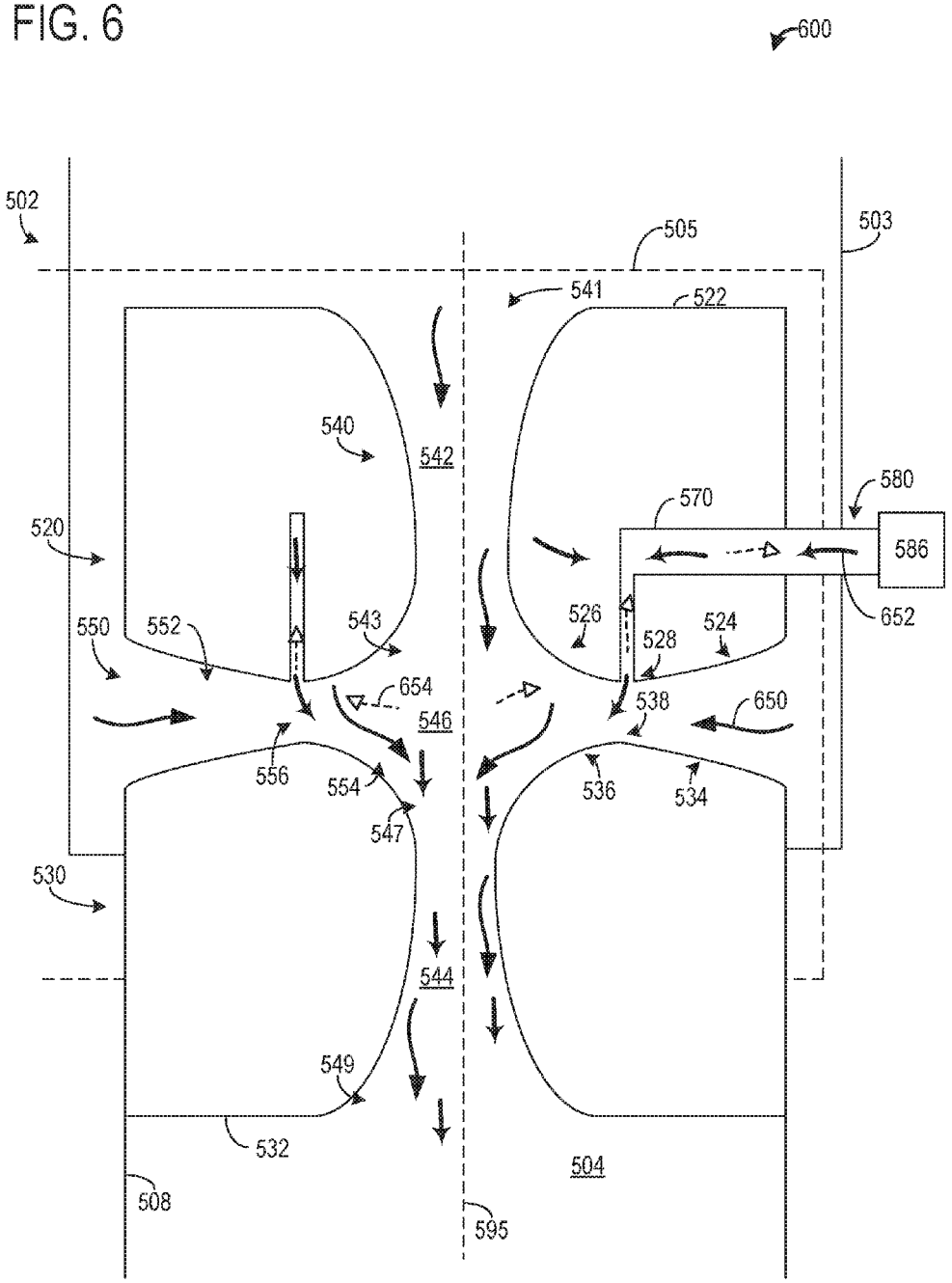
FIG. 6 depicts a cross-section of the second embodiment.
Figure 7:
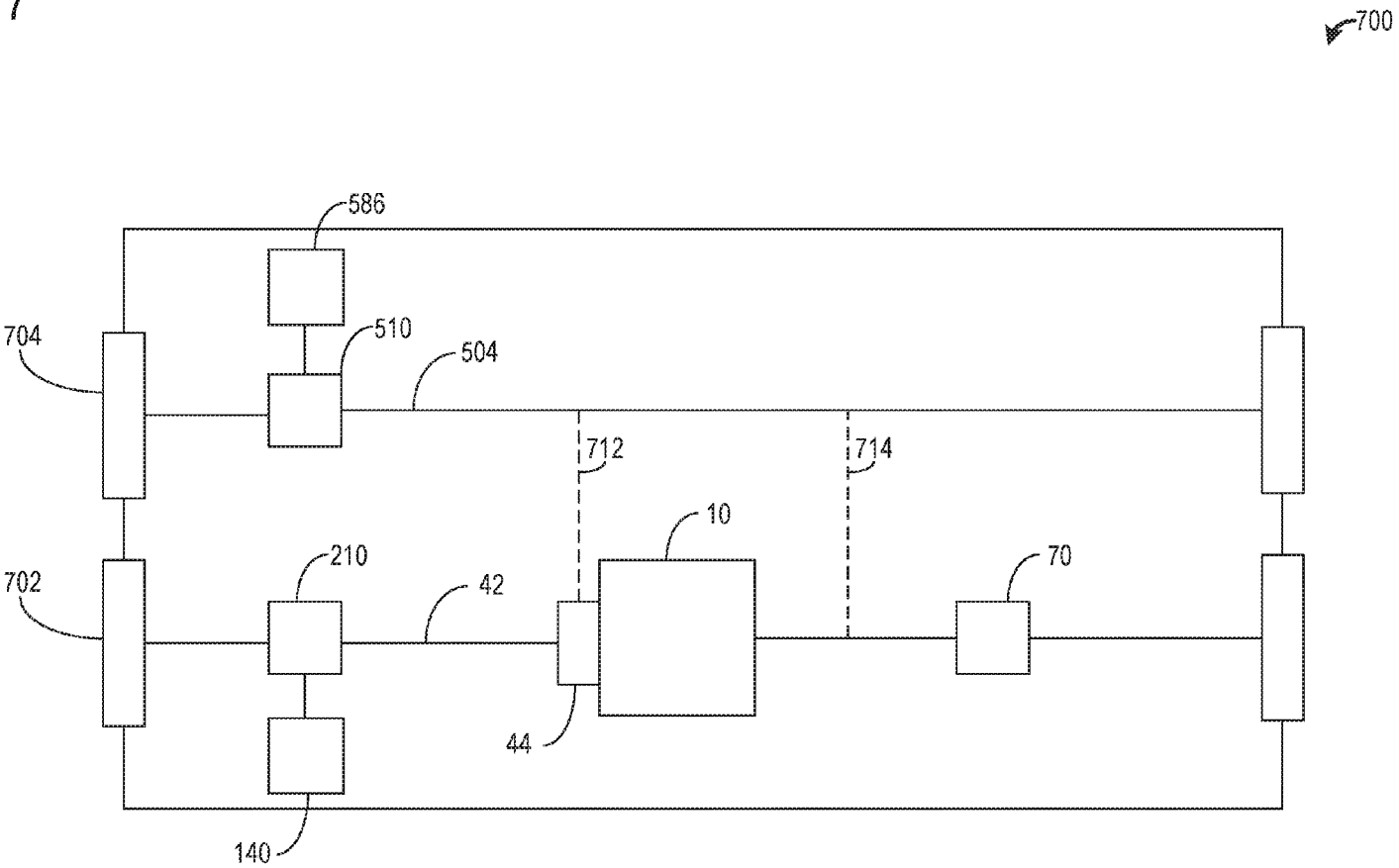
FIG. 7 depicts a system comprising the first embodiment and the second embodiment.

The following description relates to systems and methods for replenishing vacuum in a vacuum consumption device. The vacuum consumption device may be used in an engine system, where it is coupled to a first vacuum generating device in an intake passage and/or to a second vacuum generating device in an auxiliary passage, as shown in FIG. 1. The first vacuum generating device comprises upper and lower halves having substantially identical outer surfaces. The halves are hollow and configured to supply vacuum from an annular venturi passage to the vacuum consumption device, as shown in FIG. 2. A motive air flow, suck flow, and vacuum flow through the first vacuum generating device in a first position is shown in FIG. 3. A motive air flow, suck flow, and vacuum flow through the first vacuum generating device in a second position is shown in FIG. 4. The second vacuum generating device comprises upper and lower halves substantially identical to the halves of the first vacuum generating device. The second vacuum generating device also comprises an annular venturi passage, however, the second vacuum generating device differs from the first in that it is completely fixed, while the first vacuum generating device comprises slidable components. The second vacuum generating device is shown in FIG. 5. A motive air flow, suck flow, and vacuum flow through the second vacuum generating device is shown in FIG. 6. Lastly, a system comprising both the first and second vacuum generating devices is shown in FIG. 7.

FIGS. 1-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation). Additionally, upstream and downstream are in relation to a direction of gas flow unless otherwise specified.

Referring now to FIG. 1, it shows a schematic depiction of a spark ignition internal combustion engine 10. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Combustion chamber 30 (also known as, cylinder 30) of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel (not shown) to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion chamber 30 for injecting fuel directly therein in proportion to the pulse width of signal FPW received from controller 12 via electronic driver 96. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake manifold 44 in a configuration that provides what is known as port injection of fuel into the intake port upstream of combustion chamber 30.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Engine 10 may further include a compression device such as a turbocharger or supercharger including at least a compressor 162 arranged along intake passage 42. For a turbocharger, compressor 162 may be at least partially driven by a turbine 164 (e.g., via a shaft) arranged along exhaust passage 48. Compressor 162 draws air from intake passage 42 to supply boost chamber 46. Exhaust gases spin turbine 164 which is coupled to compressor 162 via shaft 161. For a supercharger, compressor 162 may be at least partially driven by the engine and/or an electric machine, and may not include a turbine. Thus, the amount of compression provided to one or more cylinders of the engine via a turbocharger or supercharger may be varied by controller 12.

A wastegate 168 may be coupled across turbine 164 in a turbocharger. Specifically, wastegate 168 may be included in a bypass 166 coupled between an inlet and outlet of the exhaust turbine 164. By adjusting a position of wastegate 168, an amount of boost provided by the turbine may be controlled.

Intake manifold 44 is shown communicating with throttle 62 having a throttle plate 64. In this particular example, the position of throttle plate 64 may be varied by controller 12 via a signal provided to an electric motor or actuator (not shown in FIG. 1) included with throttle 62, a configuration that is commonly referred to as electronic throttle control (ETC). Throttle position may be varied by the electric motor via a shaft. As elaborated in FIGS. 2-4, throttle plate 64 may be at least partially hollow and may include an opening 68 which fluidically couples the throttle with vacuum consumption device 140. Throttle 62 may control airflow from intake boost chamber 46 to intake manifold 44 and combustion chamber 30 among other engine cylinders. The position of throttle plate 64 may be provided to controller 12 by throttle position signal TP from throttle position sensor 58.

Engine 10 is coupled to vacuum consumption device 140 which may include, as non-limiting examples, one of a brake booster, a fuel vapor canister, and a vacuum-actuated valve (such as a vacuum-actuated wastegate and/or EGR valve). Vacuum consumption device 140 may receive vacuum from a plurality of vacuum sources. One source may be vacuum pump 77 that may be selectively operated via a control signal from controller 12 to supply vacuum to vacuum consumption device 140. Check valve 69 allows air to flow to vacuum pump 77 from vacuum consumption device 140 and limits airflow to vacuum consumption device 140 from vacuum pump 77. As an example, the check valve 69 allows air to flow to the vacuum pump 77 from the vacuum consumption device 140 in response to a pressure of the vacuum pump 77 being less than a pressure of the vacuum consumption device 140. In some examples, additionally or alternatively, the vacuum pump 77 may be located in an auxiliary passage outside of the intake passage 42. As air flows through the auxiliary passage, the vacuum pump 77 may supply vacuum to the vacuum consumption device 140, as will be described in greater detail below.

Another source of vacuum may be throttle plate 64 which is positioned within boost chamber 46. As shown in FIG. 1, an opening 68 within throttle plate 64 may be connected to vacuum consumption device 140 via a hollow shaft mounted on bearings (not shown) and coupled to a conduit 198. A position of the throttle plate 64 may be adjusted based on a manifold pressure, in some examples. Check valve 73 ensures that air flows from vacuum consumption device 140 to throttle plate 64 and thereon into intake manifold 44 and not from intake manifold 44 to vacuum consumption device 140. In one example, the throttle 62 and the vacuum pump 77 are substantially identical devices.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof.

An exhaust gas recirculation (EGR) system may be used to route a desired portion of exhaust gas from exhaust passage 48 to intake manifold 44 through conduit 152 via EGR valve 158. Alternatively, a portion of combustion gases may be retained in the combustion chambers, as internal EGR, by controlling the timing of exhaust and intake valves.

Controller 12 is shown in FIG. 1 as a conventional microcomputer including: microprocessor unit 102, input/output ports 104, read-only memory 106, random access memory 108, keep alive memory 110, and a conventional data bus. Controller 12 commands various actuators such as throttle plate 64, EGR valve 158, and the like. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by vehicle operator 132; a measurement of engine manifold pressure (MAP) from pressure sensor 121 coupled to intake manifold 44; a measurement of boost pressure from pressure sensor 122 coupled to boost chamber 46; a measurement of vacuum in vacuum consumption device 140 from pressure sensor 125, a profile ignition pickup signal (PIP) from Hall effect sensor 118 (or other type) coupled to crankshaft 40; a measurement of air mass entering the engine from mass airflow sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

The controller 12 receives signals from the various sensors of FIG. 1 and employs the various actuators of FIG. 1 to adjust engine operation based on the received signals and instructions stored on a memory of the controller. For example, adjusting the throttle plate may include adjusting an actuator of the throttle plate to adjust a position of the throttle plate. As an example, the actuator may be signaled to move the throttle plate to a more open position in response to a tip-in (e.g., accelerator pedal 130 in a more depressed position).

As described above, FIG. 1 merely shows one cylinder of a multi-cylinder engine, and that each cylinder has its own set of intake/exhaust valves, fuel injectors, spark plugs, etc. Also, in the example embodiments described herein, the engine may be coupled to a starter motor (not shown) for starting the engine. The starter motor may be powered when the driver turns a key in the ignition switch on the steering column, for example. The starter is disengaged after engine start, for example, by engine 10 reaching a predetermined speed after a predetermined time. Turning now to FIG. 2, it shows an isometric view 200 of a vacuum generating device 210.

Portions of the vacuum generating device 210 shown in dashed lines are occluded by portions of the vacuum generating device 210 shown in solid lines. In one example, the vacuum generating device 210 may be used as the throttle 62 of FIG. 1. Additionally or alternatively, the vacuum generating device 210 may be used as the vacuum pump 77 of FIG. 1. As such, the vacuum generating device 210 may be adapted to be located in the intake passage 42 or in an auxiliary passage fluidly coupling the vacuum generating device 210 to an ambient atmosphere.

An axis system 290 is shown comprising three axes namely, an x-axis parallel to the horizontal direction, a y-axis parallel to the vertical direction, and a z-axis perpendicular to the x- and y-axes. A direction of gravity is shown by arrow 299, which is parallel to the y-axis. A vertical axis 295 is shown extending through a geometric center of the vacuum generating device 210 parallel to the y-axis.

The vacuum generating device 210 may be partially hollow and configured to admit air therethrough to provide vacuum to a vacuum consumption device. The vacuum generating device 210 may flow the air to an intake manifold of an engine (e.g., similar to throttle 62 of FIG. 1), in some examples. Alternatively, the vacuum generating device 210 may flow the air to an ambient atmosphere, in other examples. As such, a vehicle may comprise two of the vacuum generating device 210, with one located in an intake passage and the second located outside the intake passage (e.g., in the auxiliary passage) functioning as an auxiliary vacuum generating device.

The vacuum generating device 210 comprises upper 220 and lower 230 halves aligned with one another along the vertical axis 295. Upper body 222 and upper outer surface 224 of the upper half 220 are substantially identical to the lower body 232 and lower outer surface 234 of the lower half 230, respectively. In one example, the upper 222 and lower 232 bodies are cylindrical and partially hollow for flowing air therethrough. Furthermore, the upper outer surface 224 and lower outer surface 234 are convex and protrude into a space between the halves, forming an annular venturi passage 250 located therebetween, as will be described below. The upper outer surface 224 and lower outer surface 234 protrude toward one another. The upper 224 and lower 226 outer surfaces are toroidal, in one example. In other examples, the upper 224 and lower 226 outer surfaces may be frustconical or other similar geometries.

Specifically, the lower half 230 comprises a lower outer surface 234 and a lower inner surface 236 angled oppositely toward one another. The lower outer 234 and lower inner 236 surfaces meet at a lower apex 238. The upper half 220 also comprises the upper outer surface 224 being oppositely angled to an upper inner surface with an upper apex 228 located at an intersection of the two. A distance between the upper half 220 and the lower half 230 is smallest between the upper apex 228 and the lower apex 238. During some conditions, the upper 228 and lower 238 apices may be pressed against each other, sealing a venturi passage 250. The venturi passage 250 is annular and located between the upper 220 and lower 230 halves. As such, the upper outer surface 224 and the lower outer surface 234 correspond to a venturi inlet 252 of the venturi passage 250. The upper inner surface and lower inner surface 236 correspond to a venturi outlet 254. Lastly, the upper apex 228 and the lower apex 238 corresponds to a venturi throat 256. Each of the venturi inlet 252, venturi outlet 254 and venturi throat 256 are annular, with the outlet 254 located adjacent to the vertical axis 295 and the inlet 252 being spaced farthest away from the vertical axis 295.

The vacuum generating device 210 is located in a pipe 202. Two embodiments of the pipe 202 are shown. A first embodiment 203 is shown in solid line and is concentric with the upper 220 and lower 230 halves about the vertical axis 295. The first embodiment 203 traverses in a direction parallel to the vertical axis 295. A diameter of the first embodiment 203 is greater than diameters of the upper 220 and lower 230 halves up to a junction where the first embodiment 203 is physically coupled to the lower body 232 of the lower half 230. The upper half 220 may comprise one or more supports and/or connectors slidingly coupled to the first embodiment 203. Additionally or alternatively, a coupling element may couple the upper 220 and lower 230 halves.

A second embodiment 205 of the pipe 202 is shown in dashed line and is perpendicular to the vertical axis 295. The second embodiment 205 is annular and increases in diameter adjacent to the vacuum generating device 210. The second embodiment 205 is coupled to the upper 220 and lower 230 halves. The coupling may be via bosses and or other suitable coupling elements capable of allowing one or more of the upper 220 and lower 230 halves to actuate (e.g., slide) parallel to the vertical axis 295. The coupling between the vacuum generating device 210 and the pipe 202 is described in greater detail below.

The pipe 202 is configured to admit air from the ambient atmosphere via passage 204. In one example, the passage 204 is similar to intake passage 44 of FIG. 1. Thus, the air is intake air and is directed to engine 10 of FIG. 1. Alternatively, the passage 204 is an auxiliary passage separated from the intake passage 44 of FIG. 1. As such, ambient air may flow into the passage 204 from the ambient atmosphere without flowing to the engine 10 and/or intake passage 44. Therefore, air enters the passage 204 from the ambient atmosphere, flows through the vacuum generating device 210, and exits the passage 204 to the ambient atmosphere when the passage 204 is an auxiliary passage. A portion of the passage 204 upstream of and adjacent to the vacuum generating device 210 is located in the pipe 202. A remaining portion of the passage 204 downstream of the vacuum generating device 210 is located in an outlet conduit 208 physically coupled to the lower half 230.

In some examples, additionally or alternatively, a plurality of vacuum generating devices 210 may be utilized on a vehicle, with one located in an intake passage (e.g., intake passage 42 of FIG. 1) and a second located in an auxiliary passage separated from the intake passage. Gas flows from the intake and auxiliary passages may merge in the intake manifold 44 in one example. In other examples, the auxiliary passage may expel gas to an ambient atmosphere without mixing with gas from the intake passage.

As described above, the upper 220 and lower 230 halves are partially hollow. Specifically, the upper half 220 comprises interior passages 240 including a first passage 242 and a second passage 244. The first passage 242 is located along the vertical axis 295 and is cylindrically shaped. The second passage 244 is radially spaced from the vertical axis 295 and is ring shaped with the first passage 242 extending therethrough. The first 242 and second 244 passages are fluidly connected to one another at a trifurcated passage 246, which comprises two outer passages leading to the second passage 244 and a central passage leading to the first passage 242. A conduit 280 fluidly couples the upper half 220 and the trifurcated passage 246 to the vacuum consumption device (e.g., vacuum consumption device 140 of FIG. 1). Specifically, the conduit 280 directs suck flow from the vacuum consumption device to the trifurcated passage 246 while simultaneously flowing vacuum to the vacuum consumption device, as will be described below.

A check valve 248 in the first passage 242 may dictate a direction of flow of suck flow and vacuum flow through the upper half 220. In one example, the check valve 248 may actuate to an open position in response to a vacuum exceeding a threshold vacuum, as will be described below. Alternatively, the check valve 248 may actuate to a closed position in response to a vacuum of the venturi passage 250 being less than the threshold vacuum. When the check valve 248 is in the open position, more suck flow may flow from the vacuum consumption device to the first passage 242. Thus, when the check valve 248 is in the closed position, more suck flow may flow from the vacuum consumption device to the second passage 244. Gas in the first passage 242 exits the upper half 220 along the vertical axis 295, radially interior to the upper inner surface. The first passage 242 comprises an outlet 243 facing the lower half 230. Gas in the second passage 244 exits the upper half 220 via the upper apex 228. As such, vacuum from the venturi passage 250 enters the upper half 220 through the upper apex 228 via the second passage 244.

The lower half 230 comprises an interior passage 239 located radially interior to the lower inner surface 237. The interior passage 239 is aligned with the first passage 242 along the vertical axis 295. Thus, an inlet 272 of the interior passage 239 is located directly opposite the outlet 243 such that the inlet 272 and outlet 243 face one another. In one example, a diameter of the interior passage 239 is greater than a diameter of the first passage 242. This allows the interior passage 239 to direct air flow from the passage 204 and first passage 242 to the outlet conduit 208.

Thus, during a condition where the check valve 248 is in a closed position, gas may flow through the pipe 202 and around the venturi passage 250 before flowing into the venturi inlet 252. The gas flows annularly through the venturi inlet 252, before flowing radially inward passed the venturi throat 256, and into the venturi outlet 254, where the gas is directed to the interior passage 239. As the gas flows by the venturi throat 256 (between the upper 228 and lower 238 apices), vacuum is generated and supplied through the second passage 244 to the vacuum consumption device. As vacuum in the vacuum consumption device is replenished, air flows out of the vacuum consumption device, into the second passage 244, and into the venturi passage 250. Air flow during the closed check valve position is described in greater detail in FIG. 3.

Furthermore, during a condition where the check valve 248 is in an open position, gas flowing through the pipe 202 does not enter the venturi passage 250 due to upper 228 and lower 238 apices being pressed against one another. Vacuum from the intake manifold draws air out of the vacuum consumption device through the first passage 242 and replenishes vacuum in the vacuum consumption device. The air flows through the first passage 242, through the interior passage 239, and into the intake manifold 44. Air flow during the open check valve position is described in greater detail in FIG. 4.

Turning now to FIG. 3, it shows cross-sectional view 300 taken along cutting plane M-M' shown in FIG. 2. As such, components previously presented are similarly numbered and not reintroduced. The vacuum generating device 210 is shown fluidly coupled to the vacuum consumption device 140 and intake manifold 44. Thus, the passage 204 is substantially identical to intake passage 42 or boost chamber 46 of FIG. 1. In this way, the vacuum generating device 210 may be used similarly to throttle 64 of FIG. 1.

The check valve 248 is in the fully closed position, thereby preventing air from flowing through the first passage 242. This may occur in response to a vacuum in the first passage 242 being less than a threshold vacuum, where the threshold vacuum is based on an amount of vacuum capable of opening the check valve 248. In one example, if an engine load is greater than a low engine load and/or idle engine load, then an intake manifold vacuum may be less than the threshold vacuum. However, during higher engine loads above the low and/or idle engine loads, a sufficient mass air flow may flow through the venturi passage 250. As a result, vacuum is generated at the venturi throat 256 and supplied to the vacuum consumption device 140 through the second passage 244.

The vacuum generating device 210 is shown comprising upper 320 and lower 330 connectors rigidly coupled to the upper 220 and lower 230 halves, respectively. The upper 320 and lower 330 connectors comprise upper 322 and lower 332 locking elements, respectively, for preventing the upper 220 and lower 230 halves from sliding apart from one another. As shown, the upper 322 and lower 332 locking elements are hooked shaped and are oriented oppositely one another. In one example, the upper locking element 322 points in a direction opposite gravity 299 whereas the lower locking element 332 points in a direction parallel to gravity 299. To prevent misalignment and/or separation of the upper 220 and lower 230 halves, tips 324 and 334 of the upper 322 and lower 332 locking elements, respectively, do not become dislodged. Said another way, tip 334 is more proximal to the upper half 220 than tip 324 throughout a range of motion of the upper 220 and lower 230 halves.

The connectors 320 and 330 may set a maximum distance between the upper 220 and lower 230 halves. This may be achieved by having the upper 320 and lower 330 connectors press against one another when the maximum distance between the upper 220 and lower 230 halves is reached. In one example, the tips 324 and 334 press against the lower 332 and upper 322 locking elements, respectively. Thus, for distances between the upper 220 and lower 230 halves less than the maximum distance, the connectors 320 and 330 may not be touching one another.

A spring 310 is located between the upper 220 and lower 230 halves. The spring 310 is physically coupled to upper inner surfaces 226 and lower inner surfaces 236 at upper 312 and lower 314 ends, respectively. The spring 310 fully expands when the upper half 220 is the maximum distance away from the lower half 230. Thus, the spring 310 is fully contracted when the upper half 220 is pressed against the lower half 230, as shown in FIG. 4. In this way, the maximum distance may also be set by the spring 310. Unwanted noises during the collision between the upper 220 and lower 230 halves may be prevented via the spring 310. As a result, the spring 310 may slowly contract, thereby reducing an impact force between the upper 220 and lower 230 halves.

As described above, the lower half 230 is physically coupled to the pipe 202 in both the first 203 and second 205 embodiments. The upper half 220 may be coupled to the pipe 202 via bores 340 and 342 configured to allow the upper half 220 and upper connector 320 slide in the direction parallel to gravity 299, up and down the vertical axis 295. In this way, movement of the upper 220 and lower 230 halves is substantially prevented and only vertical movement of the upper half 220 occurs, in one example. Thus, the lower half 230 is rigidly fixed to the pipe 202.

In the embodiment of FIG. 3, the upper half 220 is spaced away from the lower half 230. Specifically, the upper half 220 is a maximum distance away from the lower half 230, as indicated by the upper 322 and lower 332 locking elements being pressed against each other. In one example, the upper half 220 slides away from the lower half 230 as an intake manifold pressure increases above a threshold lower manifold pressure. When the upper half 220 is the maximum distance away from the lower half 230, the intake manifold pressure is equal to a threshold upper manifold pressure. Thus, the intake manifold pressure may be pushing the upper half 220 away. The threshold lower manifold pressure may be based on a pressure of the manifold during idle and/or low engine loads. The threshold upper manifold pressure may be based on a pressure of the manifold during high engine loads. As such, the upper half 220 may be gradually pushed away from the lower half 230 as the manifold pressure increases from the threshold lower manifold pressure to the threshold upper manifold pressure.

In some examples, additionally or alternatively, the upper half 220 may be actuated by a motor 380 based on engine operating parameters. For example, a controller (e.g., controller 12 of FIG. 1) may signal to the motor 380 to actuate the upper half 220 farther away from the lower half 230 if an intake air demand of the engine is not being met. In this way, the vacuum generating device 210 may be actuated based on an engine air demand whether it is used as a throttle or as an auxiliary vacuum device.

Ambient air 350 flows through the pipe 202 toward the vacuum generating device 210. The ambient air may be admitted to pipe 202 from an ambient atmosphere via a grill and/or fan.

Suck flow 352 flows from the vacuum consumption device 140 to the vacuum generating device 210. The suck flow is drawn from a vacuum reservoir of the vacuum consumption device 140 as its vacuum is replenished.

Vacuum 354 is generated in the venturi passage 250, where the vacuum 354 flows through the second passage 244 to the vacuum consumption device 140.

Ambient air 350 flows annularly around the vacuum generating device 210 before flowing radially inward into the venturi passage 250 via the venturi inlet 252. As described above, the venturi passage 250 is annular, spanning an entire distance of the space between the upper 220 and lower 230 halves. The ambient air 350 flows through the venturi throat 256 before entering the venturi outlet 254. As the ambient air 350 flows through the venturi throat 256, vacuum is generated adjacent to the upper 228 and lower 238 apices. As such, the vacuum 354 flows into the second passage 244 and is supplied to the vacuum consumption device 140 via the conduit 280. In return, suck flow 352 flows out of the vacuum consumption device 140, through the second passage 244, and delivered to the venturi passage 250 via an annular opening 358 of the upper apex 228. Suck flow 352 and vacuum 354 do not flow to the first passage 342 when the check valve 348 is in the closed position, in one example. The ambient air 350 and suck flow 352 may merge in the venturi outlet 254 before flowing through the interior passage 239 to the intake manifold 44. An outlet pipe 360 expels the mixture of ambient air 350 and suck flow 352 from the interior passage 239 to the intake manifold 44. The outlet pipe 360 is concentric with the outlet conduit 208 about the vertical axis 295. Additionally, the outlet pipe 360 is smaller in diameter than the outlet conduit 208. In some examples, the outlet pipe 360 may be omitted.

In one example, the embodiment of FIG. 3 may occur during a high engine load with a vehicle driving on a road. Intake manifold vacuum is low compared to lower engine loads and in response, the check valve remains in the closed position. Additionally, a force of the spring is greater than the manifold vacuum, urging the upper half away from the lower half. The connectors set a maximum distance between the upper and lower halves. The venturi passage opens between the upper and lower halves, where ambient air flows therethrough. Vacuum from the venturi passage flows in to a second passage located wholly inside the upper half. Suck flow exits a vacuum reservoir of a vacuum consumption device as vacuum in the reservoir is replenished. In this way, suck flow mixes with ambient air in the venturi passage when the halves are spaced away from each other.

Turning now to FIG. 4, it shows cross-sectional view 400, which is substantially identical to the cross-sectional view 300, expect that the upper half 220 is pressed against the lower half 230. Specifically, the upper apex 228 is pressed against the lower apex 238 and as a result, the second passage 244 and venturi passage 250 are sealed. A pressure of the intake manifold may be less than the threshold lower pressure. As such, a vacuum of the intake manifold is high enough to move the check valve 248 toward the open position. Additionally, the spring 310 is moved to a fully compressed position as the manifold vacuum exceeds the force of the spring 310. As such, ambient flow 450 cannot flow through the venturi throat 256 due to upper 228 and lower 238 apices being pressed against one another. Vacuum 454 flows from the intake manifold 44 to the vacuum consumption device 140 through the open check valve 248 in the first passage 242. Suck flow 452 flows through the first passage 242 along the vertical axis 295, through the check valve 248, through the venturi passage 250, through the interior passage 239, through the outlet pipe 360, and into the outlet conduit 208 toward the intake manifold 44. As such, during engine operating conditions where intake manifold pressure is low (e.g., low engine loads and/or idle), only suck flow flows through the vacuum generating device 210 to the intake manifold 44.

In one example, the check valve is closed when a vehicle is stopped and in idle. Vacuum from the manifold overcomes the force of the spring and moves the upper half closer to the lower half. The spring slowly contracts to decrease an impact force between the upper and lower halves, thereby mitigating noises generated therefrom. The second passage is sealed from the venturi passage and the intake manifold. Additionally, the venturi passage is sealed from an ambient air passage. Vacuum flows from the manifold through the venturi passage, through the first passage, and to the vacuum consumption device. Suck flow flows exactly opposite to vacuum and is the only source of intake air provided to the intake manifold in one example. In another example, the vacuum generating device is in an auxiliary passage such that the intake manifold may receive ambient air from the vacuum generating device and a throttle.

Thus, FIGS. 3 and 4 show two extreme positions of the vacuum generating device, including a first position where the upper half is farthest away from the lower half and a second position where the upper half is pressed against the lower half. When in the first position, the check valve is closed and ambient air flowing through the venturi passage promotes the flow of suck flow from the vacuum consumption device to the venturi passage via the second passage in the upper half. The motive air and suck flow combine and flow through the interior passage of the lower half before flowing to the intake manifold. When in the second position, the check valve is open and intake manifold vacuum promotes suck flow to flow through the first passage, through the interior passage, and into the intake manifold.

In some embodiments, additionally or alternatively, the vacuum generating device may comprise a third position between the first and second positions. As such, suck flow may flow through both the first and second passages when the vacuum generating device is in the third position. In this way, the check valve is at least partially open and the upper half is at least slightly spaced away from the lower half, thereby allowing motive flow to enter the venturi passage.

Thus, a system comprising a vacuum generating device includes an upper half with surfaces identical to a lower half, and where the halves are aligned along a vertical axis, an annular venturi passage located between the upper and lower halves, the venturi passage being fluidly coupled to a passage configured to receive ambient air, and a vacuum consumption device being fluidly coupled to the annular venturi passage via interior passages of the upper half. The upper half comprises an upper apex and the lower half comprises a lower apex. A distance between the upper and lower halves is smallest between the upper and lower apices. The upper half is slidable parallel to the vertical axis and the lower half is stationary, and where a first position includes spacing the upper half away from the lower half and a second position includes pressing the upper apex of the upper half to the lower apex of the lower half. The second position further includes preventing ambient air flow to the annular venturi passage via sealing the annular venturi passage from the passage. The interior passages of the upper half include a first passage and a second passage, the first passage being cylindrical and located along the vertical axis, and where the second passage is annular and concentric with the first passage about the vertical axis. The first passage fluidly couples the vacuum consumption device to the annular venturi passage in the second position and the second passage fluidly couples the vacuum consumption device to the annular venturi passage in the first position. The lower half comprises an inner passage fluidly coupling the annular venturi passage to an intake manifold, and where vacuum from the intake manifold flows to the vacuum consumption device via the first passage. The vacuum generating device is a throttle and the passage is an intake passage.

Turning now to FIG. 5 it shows an isometric view 500 of a vacuum generating device 510. The vacuum generating device 510 may be used substantially similarly as the vacuum generating device 210 shown in the embodiment of FIG. 2. In one example, the vacuum generating device 510 differs from the vacuum generating device 210 in that it is fixed and does not comprise any sliding components. As such, the vacuum generating device 510 may only be used as an auxiliary vacuum generating device (e.g., vacuum pump 77 in the embodiment of FIG. 1) while the vacuum generating device 210 may be used as a throttle (e.g., throttle 64 in the embodiment of FIG. 1) or an auxiliary vacuum generating device (e.g., vacuum pump 77 in the embodiment of FIG. 1).

In this way, a system (e.g., a vehicle) may comprise the vacuum generating device 210 functioning similarly to throttle 62 in intake passage 42 of FIG. 1 and the vacuum generating device 510 functioning as an auxiliary vacuum generating device in an auxiliary passage completely outside of the intake passage. In one example, the vacuum generating device 210 and vacuum generating device 510 are coupled to different vacuum consumption devices (e.g., an EGR valve and a brake booster). In another example, the vacuum generating device 210 and the vacuum generating device 510 are coupled to the same vacuum consumption device.

As shown, vacuum generating device 510 is located in auxiliary passage 504. The auxiliary passage 504 is located completely outside of passage 204 of FIG. 2. In some examples, both the auxiliary passage 504 and the passage 204 expel air to intake manifold 44 of FIG. 1. In other examples, the auxiliary passage 504 expels air to an ambient atmosphere through a grill located on a rear face of a vehicle.

An axis system 590 is shown comprising three axes, namely an x-axis parallel to the horizontal direction, a y-axis parallel to the vertical direction, and a z-axis perpendicular to the x- and y-axes. A direction of gravity is shown by arrow 599, which is parallel to the y-axis. A vertical axis 595 is shown extending through a geometric center of the vacuum generating device 510 parallel to the y-axis.

The vacuum generating device 510 may be a partially hollow device configured to admit gas therethrough to provide vacuum to a vacuum consumption device 586. The vacuum generating device 510 may expel the gas to an intake manifold of an engine (e.g., similar to throttle 62 of FIG. 1), in one example. Alternatively, the vacuum generating device 510 may expel the gas to an ambient atmosphere. By doing this, the vacuum generating device 510 may be located in an auxiliary passage 504 with an inlet and an outlet fluidly coupled to the ambient atmosphere, and where the auxiliary passage 504 is fluidly sealed from an engine and/or other components of a vehicle excluding the vacuum consumption device 586.

The vacuum generating device 510 comprises upper 520 and lower 530 halves aligned with one another along the vertical axis 595. Upper body 522 and upper outer surface 524 of the upper half 520 are substantially identical to the lower body 532 and lower outer surface 534 of the lower half 530. In one example, the upper 522 and lower 532 bodies are cylindrical and partially hollow for flowing air therethrough. Furthermore, the upper outer surface 524 and lower outer surface 534 are convex and form an annular venturi passage 550 located therebetween, as will be described below. In one example, outer surfaces of the upper 520 and lower 530 halves (e.g., upper 522 and lower 532 bodies, and upper outer 524 and lower outer 534 surfaces) are substantially identical to the outer surfaces of the upper 220 and lower 230 halves (e.g., upper 222 and lower 232 bodies, and upper outer 224 and lower outer 234 surfaces). Thus, venturi passage 550 is substantially identical to venturi passage 250. In this way, only interior portions of the upper 520 and lower 530 halves and upper 220 and lower 230 halves are different.

Specifically, the lower half 530 comprises a lower outer surface 534 and a lower inner surface 536 angled oppositely toward one another. The lower outer 534 and lower inner 536 surfaces meet at a lower apex 538. As such, the lower outer surface 534 corresponds to a venturi inlet 525 of the venturi passage 550. The lower inner surface 536 corresponds to a venturi outlet 554. The lower apex 558 corresponds to a venturi throat 556.

Since outer surfaces of the upper 520 and lower 530 halves are substantially identical, the upper half 520 also comprises the upper outer surface 524 being oppositely angled to an upper inner surface with an upper apex 528 located at an intersection of the two. A distance between the upper half 520 and the lower half 530 is smallest between the upper apex 528 and the lower apex 538.

The vacuum generating device 510 is located in a pipe 502. Two embodiments of the pipe 502 are shown. A first embodiment 503 is shown in solid line and is concentric with the upper 520 and lower 530 halves about the vertical axis 595. The first embodiment 503 is physically coupled to the lower half 530 below the lower outer surface 534. Downstream of and/or vertically below the lower half 530, an outlet conduit 508 fluidly couples the vacuum generating device 510 to an intake manifold (e.g., intake manifold 44 of FIG. 1) with a diameter substantially equal to a greatest diameter of the lower half 530. The upper half 520 is spaced away from and located wholly inside the first embodiment 503.

A second embodiment 505 of the pipe 502 is shown in dashed lines and is perpendicular to the vertical axis 595. The second embodiment 505 surrounds the upper 520 and lower 530 halves. Similar to the first embodiment 503, the second embodiment 505 is physically coupled to the lower half 530 below the lower outer surface 534. The upper half 520 is located completely inside of the second embodiment 505, while the lower half 530 is only partially located inside the second embodiment 505. The venturi passage 550 is completely located inside the second embodiment 505. The upper half 520 is spaced away from the second embodiment 505 such that the upper body 522 does not touch interior surfaces of the second embodiment 505.

The upper half 520 is fixed in the pipe 502 and does not move. In one example, a plurality of supports 506 and/or stand-offs 506 may physically couple the upper half 520 to the lower half 530. In this way, the upper half 520 is cantilevered in the pipe 502. Said another way, the upper half 520 is spaced away from the lower half 530 with no portions of the upper half 520 contacting any portions of the lower half 530, and where stand-offs 506 are coupled to the upper 520 and lower 530 halves at opposite ends. Alternatively, the upper half 520 may also be coupled to the pipe 502 via one or more bores 582 coupling the conduit 580 to the pipe 502. The conduit 580 fluidly couples the upper half 520 to the vacuum consumption device 586, as will be described below.

The pipe 502 is configured to flow ambient air, whether in the first embodiment 503 or second embodiment 505, to the venturi passage 550 and upper interior passage 542 of the upper half 520 via the auxiliary passage 504. The ambient air may flow through a grill located on a front of a vehicle fluidly coupling auxiliary passage 504 to the ambient atmosphere. In one example, the auxiliary passage 504 may expel ambient air to the ambient atmosphere without flowing ambient air to the engine. Alternatively, the auxiliary passage 504 may flow ambient air and/or suck flow to an intake manifold of an engine.

Ambient air in the auxiliary passage 504 may flow to the outlet conduit 508 by flowing through the venturi passage 550 and/or the upper interior passage 542. Both passages expel gas to a lower interior passage 544 of the lower half 530, which expels gas to the outlet conduit 508. The venturi passage 550 comprises a venturi inlet 552 located between the upper 524 and lower 534 outer surfaces, a venturi outlet 554 located between the upper and lower 536 inner surfaces, and a venturi throat 556 located between the upper 528 and lower 538 apices. As such, vacuum may be generated in the venturi throat 556 as static pressure decreases as it flows through the venturi throat 556.

A combination of the upper 542 and lower 544 interior passages resemble a venturi passage along the vertical axis 595. Thus, the upper interior passage 542 may be referred to as a second venturi inlet 542, the lower interior passage 544 may be referred to as a second venturi outlet 544, and the space between the upper 542 and lower 544 interior passages may be referred to as a second venturi throat 546. Herein, the venturi passage 550 may be referred to as first venturi passage 550, and the venturi passage created by the upper 542 and lower 55 interior passages may be referred to as a second venturi passage 540. The second venturi throat 546 of the second venturi passage 540 is located interior to and/or adjacent to the venturi outlet 554. In this way, vacuum generated by the second venturi passage 540 may increase a vacuum generated by the first venturi passage 550, thereby allowing the first venturi passage 550 to provide a greater amount of vacuum to the vacuum consumption device 586 than the venturi passage 250 of FIG. 2.

The second venturi inlet 542 comprises an upper inlet 541 configured to receive ambient air from the auxiliary passage 504. Air in the second venturi inlet 542 is expelled to the second venturi throat 546 via an upper outlet 543. A diameter of the outlet 543 is less than a diameter of the inlet 541. The outlet 543 faces the lower half 530. Specifically, the upper outlet 543 is located directly across from a lower inlet 547 of the second venturi outlet 544. Air in the second venturi outlet 544 is expelled to outlet conduit 508 via a lower outlet 549. As shown, the lower outlet 549 extends into the outlet conduit 508. However, it will be appreciated that the lower outlet 549 may not extend into the outlet conduit 508 without departing from the scope of the present disclosure. Due to the venturi shape of the venturi passage 540, a diameter of the second venturi inlet 542 decreases from the upper inlet 541 to the upper outlet 543. Oppositely, a diameter of the second venturi outlet 544 decreases from the lower inlet 547 to the lower outlet 549.

Thus, the first venturi passage 550 is an annular venturi passage with an annular venturi inlet 552, annular venturi outlet 554, and annular venturi throat 556. The first venturi passage 550 is concentric with the second venturi passage 540 about the vertical axis 595. The second venturi passage 540 is parallel to the vertical axis 595 and traverses through the venturi outlet 554. Specifically, the second venturi throat 546 is located directly along the annular venturi outlet 554. Vacuum from the second venturi passage 540 pulls air through the annular venturi passage 550, which in turn may result in a greater amount of vacuum generated in the annular venturi throat 556 compared to only one venturi passage being located in the vacuum generating device 510. Vacuum generated by the first 550 and second 540 venturi passages flows to the vacuum consumption device 586 the upper half 520, as will be described below.

An annular interior passage 570 is fluidly coupled to the vacuum consumption device 586 via the conduit 580. As shown, the annular interior passage 570 is located wholly inside of the upper half 520. The upper interior passage 542 and annular interior passage 570 are concentric about the vertical axis 595. The upper interior passage 542 and annular interior passage 570 are wholly located inside the upper half 520, with the annular interior passage 570 circularly surrounding the upper interior passage 542. Air in the upper interior passage 542 does not mix with air in the annular interior passage 570 in the upper half 520. The annular interior passage outlet 572 is located at the upper apex 528. Thus, the upper apex 528 is completely open to the first venturi passage 550. Vacuum may flow through the annular interior passage 570 to the vacuum consumption device 586 as suck flow flows from the vacuum consumption device 586, through the annular interior passage 570, and into the venturi throat 556.

Turning now to FIG. 6, it shows a cross-sectional view 600 along a cutting plane N—N' of FIG. 5, including example motive air, suck flow, and vacuum flow through the vacuum generating device 510. As described above, the vacuum generating device 510 is fixed and does not move. In this way, the vacuum generating device 510 only generates vacuum when ram air is flowing through the auxiliary passage 504.

Ambient air 650 flows through the pipe 502 toward the vacuum generating device 510. The first venturi passage 550 and second venturi passage 540 receive ambient air flow in different directions. Ambient air flowing parallel to the vertical axis 595 may readily enter the second venturi passage 540 via the upper inlet 541 of the second venturi inlet 542. The ambient air flows through the second venturi passage 540 by passing through the second venturi inlet 542, through second venturi throat 546, and through the second venturi outlet 544. The second venturi throat 546 generates vacuum 654, which may promote ambient air to flow radially inward into the first venturi passage 550. Ambient air 650 flows through the first venturi inlet 552, venturi throat 556, and venturi outlet 554. As such, ambient air 650 from the first 550 and second 540 venturi passages merges in the second venturi throat 646. Vacuum 654 flows from the first venturi throat 556 into the annular interior passage 570, through the conduit 580, and to the vacuum consumption device 586. In response, suck flow 652 flows from the vacuum consumption device 586, through the annular interior passage 570, and into the first venturi throat 556. Suck flow 652 mixes with ambient air 650 in the second venturi throat 646 adjacent the upper inner surface 526 and lower inner surface 536, before flowing into the second venturi outlet 644. The mixture of ambient air 650 and suck flow 652 are expelled to the outlet conduit 508, where they may be directed to the ambient atmosphere.

In one example, additionally or alternatively, the auxiliary passage 504 is fluidly coupled to an intake manifold (e.g., intake manifold 44 of FIG. 1). As such, suck flow from the vacuum consumption device 586 may mix with suck flow from the vacuum consumption device 140 of FIGS. 1 and 2 in the intake manifold 44.

As shown, the vacuum generating device 510 is static. Ram air flows through the vacuum generating device 510 when a vehicle moves, resulting in vacuum flowing to the vacuum consumption device 586. In some examples, a fan may be provided upstream of the vacuum generating device 510 to provide air flow during stationary vehicle operating conditions. Upstream and downstream refer to a direction of air flow. Therefore, the fan may allow the vacuum generating device 510 to generate vacuum during vehicle stationary and vehicle moving conditions.

Thus, a system comprising an auxiliary passage fluidly separated from intake and exhaust passages of an engine may further include a vacuum generating device located in the auxiliary passage. The vacuum generating device produces vacuum as air flows through the auxiliary passage via first and second venturi passages; the first venturi passage being annularly located between identically shaped upper and lower halves of the vacuum generating device, the second venturi passage traversing through the upper and lower halves along a vertical axis. The vacuum generating device further comprises an annular interior passage circumferentially surrounding the second venturi passage inside the upper half, and where the annular interior passage is configured to flow vacuum from the first venturi passage to a vacuum consumption device. The vacuum generating device is fixed and the upper and lower halves are coupled via one or more stand-offs. The second venturi passage comprises a second venturi throat fluidly coupled to a first venturi outlet of the first venturi passage, and where vacuum from the second venturi throat is supplied to the first venturi throat. The first venturi passage is annular with a first venturi outlet located proximal to the vertical axis and a first venturi inlet located farthest away from the vertical axis. The second venturi passage comprises a second venturi inlet located inside the upper half, a second venturi outlet located inside the lower half, and a second venturi throat located between the upper and lower halves. The upper half is wholly located in a pipe of the auxiliary passage, and where the lower half is partially located in the pipe. The vacuum consumption device is one or more of a brake booster, EGR valve, and fuel-vapor canister.

Turning now to FIG. 7, it shows a system 700 comprising an engine 10, vacuum generating device 210, and vacuum generating device 510. As such, components previously presented may be similarly numbered and not reintroduced. In one example, the system 700 is a vehicle. Alternatively, the system 700 may be another device configured to draw in air and utilize vacuum consuming devices. Components described as being located at a front end are on a left side of the figure and components described as being located at a rear end are on a right side of the figure.

A first grill 702 is configured to admit motive air to the vacuum generating device 210 located in intake passage 42. Thus, in the embodiment of FIG. 7, the vacuum generating device 210 is used as throttle 64 of FIG. 1. In this way, the vacuum generating device 210 is adapted to adjust intake air flow to the engine and simultaneously replenish a vacuum of the vacuum consumption device 140.

A second grill 704 is configured to admit ram air to the vacuum generating device 510 located in auxiliary passage 504. As shown, the auxiliary passage 504 is fluidly separated from the intake passage 42. Thus, air in the auxiliary passage 504 does not mix with air in the intake passage 42. A first optional passage 712 is shown connecting the auxiliary passage 504 to the intake manifold 44. A second optional passage 714 is shown downstream of the first optional passage 712, fluidly coupling the auxiliary passage 504 to exhaust passage 48. In some examples, a valve may be located in the second optional passage 714, where the valve is configured to open during regeneration of the aftertreatment device 70. In this way, air from the auxiliary passage 504 flows to the aftertreatment device 70 when the valve is in an open position.

Thus, a method comprises replenishing vacuum in a vacuum consumption device by flowing air through an annular venturi passage located between identically shaped upper and lower halves of a vacuum generating device. The annular venturi passage comprises an annular venturi throat located between upper and lower apices of the upper and lower halves, respectively, and where the vacuum consumption device is fluidly coupled to the annular venturi throat through an annular passage of the upper half. The upper and lower halves are cylindrical and aligned with one another along a vertical axis, and where the upper and lower halves comprise protrusions extending toward one another. The protrusions form the annular venturi passage. The upper and lower halves are partially hollow and comprise passages located therein for flowing air, vacuum, and suck flow.

In this way, vacuum is provided to a vacuum consumption device via a vacuum generating device. Ambient air flows through the vacuum generating device, which comprises one or more venturi passages for producing vacuum. Thus, electronic valves and/or motors may not be coupled to the vacuum generating device, thereby reducing a packaging of the vacuum generating device. Additionally, a portion of the vacuum generating device may be spontaneously moveable based on vehicle operating conditions, such that the vacuum generating device may be used as a throttle in an intake passage. Alternatively, the vacuum generating device may be fixed and located in an auxiliary passage fluidly separated from other passages of a vehicle. The technical effect of providing one or more vacuum generating devices is to replenish vacuum of the vacuum consumption device through a plurality of vehicle operating conditions.

In an alternate embodiment a system comprises a throttle configured to provide vacuum to a first vacuum consumption device when air flows through an intake passage, a vacuum generating device configured to provide vacuum to a second vacuum consumption device when air flows through an auxiliary passage, and the throttle and vacuum generating device comprise upper and lower halves aligned along a common axis with annular venturi passages located therebetween, and where the upper half of the throttle is slidable and the halves of the vacuum generating device are fixed.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

replenishing vacuum in a vacuum consumption device by flowing air through an annular venturi passage located between identically shaped upper and lower halves of a vacuum generating device.

2. The method of claim 1, wherein the annular venturi passage comprises an annular venturi throat located between upper and lower apices of the upper and lower halves, respectively, and where the vacuum consumption device is fluidly coupled to the annular venturi throat through an annular passage of the upper half.

3. The method of claim 1, wherein the upper and lower halves are cylindrical and aligned with one another along a vertical axis, and where the upper and lower halves comprise protrusions extending toward one another.

4. The method of claim 3, wherein flowing air through the annular venturi passage includes flowing air radially inward in a direction perpendicular to the vertical axis located along a geometric center of the vacuum generating device.

5. The method of claim 1, wherein the upper and lower halves are partially hollow and comprise passages located therein for flowing air, vacuum, and suck flow.

6. A system comprising:

a vacuum generating device comprising an upper half with outer surfaces identical to a lower half, and where the halves are aligned along a vertical axis;

an annular venturi passage located between the upper and lower halves, the venturi passage being fluidly coupled to a passage configured to receive ambient air; and a vacuum consumption device being fluidly coupled to the annular venturi passage via interior passages of the upper half.

7. The system of claim 6, wherein the upper half comprises an upper apex and the lower half comprises a lower apex, and where a distance between the upper and lower halves is smallest between the upper and lower apices.

8. The system of claim 6, wherein the upper half is slidable parallel to the vertical axis and the lower half is stationary, and where a first position includes spacing the upper half away from the lower half and a second position includes pressing the upper apex of the upper half to the lower apex of the lower half.

9. The system of claim 8, wherein the second position further includes sealing the annular venturi passage from the passage and preventing ambient air flow to the annular venturi passage.

10. The system of claim 8, wherein the interior passages of the upper half include a first passage and a second passage, the first passage being cylindrical and located along the vertical axis, and where the second passage is annular and concentric with the first passage about the vertical axis.

11. The system of claim 10, wherein the first passage fluidly couples the vacuum consumption device to the annular venturi passage in the second position and the second passage fluidly couples the vacuum consumption device to the annular venturi passage in the first position.

12. The system of claim 11, where the lower half comprises an inner passage fluidly coupling the annular venturi passage to an intake manifold, and where vacuum from the intake manifold flows to the vacuum consumption device via the first passage.

13. The system of claim 8, wherein the vacuum generating device is a throttle and the passage is an intake passage.

14. A system comprising:

an auxiliary passage fluidly separated from intake and exhaust passages of an engine;

a vacuum generating device located in the auxiliary passage, where the vacuum generating device produces vacuum as air flows through the auxiliary passage via first and second venturi passages; the first venturi passage being annularly located between identically shaped upper and lower halves of the vacuum generating device, the second venturi passage traversing through the upper and lower halves along a vertical axis; and an annular interior passage circumferentially surrounding the second venturi passage inside the upper half, and where the annular interior passage is configured to flow vacuum from the first venturi passage to a vacuum consumption device.

15. The system of claim 14, wherein the vacuum generating device is fixed and the upper and lower halves are coupled via one or more stand-offs.

16. The system of claim 14, wherein the second venturi passage comprises a second venturi throat fluidly coupled to a first venturi outlet of the first venturi passage, and where vacuum from the second venturi throat is supplied to the first venturi throat.

17. The system of claim 14, wherein the first venturi passage is annular with a first venturi outlet located proximal to the vertical axis and a first venturi inlet located farthest away from the vertical axis.

18. The system of claim 14, wherein the second venturi passage comprises a second venturi inlet located inside the upper half, a second venturi outlet located inside the lower half, and a second venturi throat located between the upper and lower halves.

19. The system of claim 14, wherein the upper half is wholly located in a pipe of the auxiliary passage, and where the lower half is partially located in the pipe.

20. The system of claim 14, wherein the auxiliary receives and expels air to an ambient atmosphere.

* * * * *